United States Patent [19]

Bedell et al.

[11] 4,184,532

[45] Jan. 22, 1980

[54] CHILL ROLL CASTING OF CONTINUOUS FILAMENT

[75] Inventors: John R. Bedell, Sparta; Naim Hemmat, Mendham, both of N.J.; Donald E. Polk, Boston, Mass.

[73] Assignee: Allied Chemical Corporation, Morristown, N.J.

[21] Appl. No.: 839,546

[22] Filed: Oct. 5, 1977

Related U.S. Application Data

[63] Continuation of Ser. No. 683,121, May 4, 1976, abandoned.

[51] Int. Cl.[2] ..... B22D 11/06

[52] U.S. Cl. ..... 164/64; 164/87; 164/256; 164/423; 164/429

[58] Field of Search ..... 164/87, 276, 423, 429, 164/256, 64

[56] References Cited

U.S. PATENT DOCUMENTS

| | | | |
|---|---|---|---|
| 1,017,943 | 2/1912 | Akin | 164/423 |
| 2,383,310 | 8/1945 | Hazelett | 164/88 |
| 3,724,529 | 4/1973 | Chaulet et al. | 164/256 |
| 3,881,540 | 5/1975 | Kavesh | 164/87 |
| 3,881,542 | 5/1975 | Polk et al. | 164/87 |

FOREIGN PATENT DOCUMENTS

| | | |
|---|---|---|
| 1177758 | 1/1970 | United Kingdom . |
| 1293678 | 10/1972 | United Kingdom . |
| 1384257 | 2/1975 | United Kingdom . |
| 1421185 | 1/1976 | United Kingdom . |
| 1453148 | 10/1976 | United Kingdom . |

OTHER PUBLICATIONS

Pond and Maddin, "Method of Producing Rapidly Solidified Filamentary Castings", in Transactions of the Metallurgical Society of Aime, vol. 245, pp. 2475–2476, Nov. 1969.

*Primary Examiner*—John McQuade
*Attorney, Agent, or Firm*—Gerhard H. Fuchs; David W. Collins

[57] ABSTRACT

Improvement in apparatus for making metal filament by depositing a stream of molten metal onto the inner surface of an annular chill roll as it is being rotated includes provision of a rotably mounted annular chill roll having an inner surface substantially parallel to its axis of rotation, and means for stripping the metal filament from the inner surface of the chill roll and for guiding the stripped metal filament away from the chill roll.

15 Claims, 5 Drawing Figures

CHILL ROLL CASTING OF CONTINUOUS FILAMENT

This is a continuation, of application Ser. No. 683,121, filed May 4, 1976, now abondaned.

BACKGROUND OF THE INVENTION

This invention relates to a method and apparatus for making continuous metal filaments, particularly amorphous metal filaments, by depositing a molten stream of metal onto the inner surface of an annular chill roll while it is being rotated around its axis to form a solid filament on that surface, and withdrawing the filament.

For purposes of the present invention, a filament is a slender body whose transverse dimensions are much less than its length. In that context, filaments may be bodies such as ribbons, sheets or wires, of regular or irregular cross section.

It is already known to make metal filaments by directing a jet of molten metal against a moving chilled quenching surface whereon it is solidified. One of these known methods involves chill roll casting wherein a free jet of molten metal is impinged upon the exterior surface of a rotating drum, whereon it is solidified to form a filament, which is then flung away from the drum by centrifugal action. Chill roll casting techniques employing the exterior surface of a rotating drum or cylinder have, for example, been described by Strange and Pim in U.S. Pat. No. 905,758. Filaments formed on the exterior surface of a rotating drum may be recovered therefrom by using nipping means, as disclosed in U.S. Pat. No. 3,856,074 to Kavesh. The procedure described by Strange et al. may be readily employed to form filaments of many of the polycrystalline metals which possess sharp melting points, that is to say, which have solid-liquid transition range of less than about 5° C. However, amorphous or glassy metals often have a transition range in the order of about 400° C. or more, through which the viscosity of the metal gradually increases until the critical glass transition temperature is reached, and it is necessary for the filament to be quenched below its glass transition temperature before departure from the quench roll. This is often difficult to achieve by the procedure of Strange et al. because centrifugal force tends prematurely to fling the filament away from the drum surface.

Pond and Madden in Trans. Met. Soc. AIME, 245 (1969), pages 2475–6, describe a method for making metal filaments by directing a jet of molten metal against the inner surface of a rotating cylinder. The location of the jet is moved along the length of the cylinder, thereby producing a spiraling specimen of filament on the inner cylinder wall. Radial acceleration imparted to the liquid stream by rotation of the cylinder induces good thermal contact and spreads the stream into a flat filament prior to complete solidification. No provisions are made for stripping the filament from the drum as it is being produced, so that continuous production of filament is not possible, and the length of the filament so formed is inherently limited.

U.S. Pat. Nos. 3,881,542 and 3,939,900, both to Polk et al., are respectively directed to method and apparatus for making continuous length shaped metal filaments by casting a stream of molten metal within a groove formed in the inner periphery of a rotating cylindrical chill roll. U.S. Pat. No. 3,881,540 to Kavesh describes a process and apparatus for making continuous untwisted length of metal filament by casting a molten stream of metal onto the inner surface of an annular chill roll which inner surface is inclined at an angle of 2° to 30° to the axis of rotation of the chill roll, exerting pressure on the quenched molten stream in contact with the inclined inner surface of the chill roll after solidification, and collecting the filament thus formed.

SUMMARY OF THE INVENTION

The present invention provides an improvement in apparatus for making metal filament including an annular chill roll rotably mounted around its axis and means for depositing a stream of molten metal onto the inner surface of the chill roll as it is being rotated, which improvement comprises, in combination, provision of (a) a rotably mounted annular chill roll having an inner surface substantially parallel to its axis of rotation, and (b) means for stripping the metal filament from the inner surface of the rotating chill roll beyond the point of solidification of the stream of molten metal deposited thereon and for guiding the stripped metal filament away from the inner surface of the chill roll.

The present invention further provides a process for making metal filament which comprises depositing a stream of molten metal onto the inner surface of a rotating annular chill roll having an inner surface substantially parallel to its axis of rotation, stripping the metal filament formed by solidification of the stream of molten metal in contact with the inner surface of the rotating chill roll at a point beyond which solidification occurred, and guiding the stripped metal filament away from the inner surface of the chill roll.

The method and apparatus of the present invention advantageously permit rapid cooling of the molten metal stream deposited on the rotating chill roll to and below the critical glass transition temperature as is necessary for the production of amorphous metal filaments, since they permit intimate contact of the molten metal with the quench surface over increased periods of time. The method and apparatus of the present invention are eminently suited for making filaments of polycrystalline metals, of alloys forming amorphous metals, and of nonductile or brittle alloys which are not readily formable into filaments using conventional processes.

BRIEF DESCRIPTION OF THE DRAWINGS

In FIG. 1 there is shown one embodiment employing an air jet for stripping the metal filament from the inner surface of the rotating chill roll and for guiding the stripped filament away from the chill roll and to a suitable collecting device (not shown).

In FIG. 2 there is shown another embodiment employing a blade in sliding contact with the inner surface of the chill roll for stripping the metal filament therefrom together with a mechanical guide for directing the stripped filament away from the chill roll and to a collecting device (not shown).

FIGS. 3 and 4 respectively illustrate a rotating brush and an aspirator for stripping filament from the chill roll and guiding it to a suitable collecting device (not shown).

DETAILED DESCRIPTION OF THE INVENTION AND OF THE PREFERRED EMBODIMENTS

Figure 1:
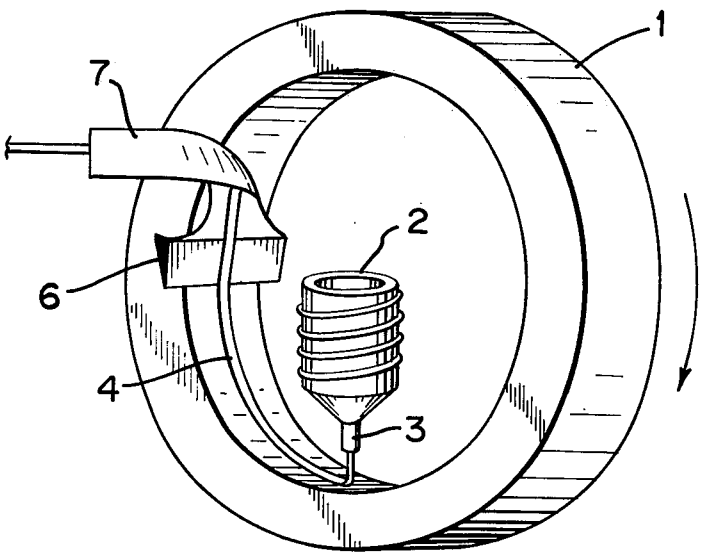
FIGS. 1 through 4 of the drawings each provides a side view of embodiments of the apparatus of the present invention.

With reference to FIG. 1, apparatus employed comprises a chill roll 1 rotably mounted around its longitudinal axis, crucible 2 equipped with induction heating coils for holding molten metal for spraying onto the inner surface of chill roll 1 through nozzle 3, and air knife 5 for stripping the metal filament 4 from the inner surface of the chill roll, and for guiding it away from the chill roll and to a suitable collection device (not shown). In operation, a stream of molten metal is ejected through nozzle 3 onto the inner surface of rotating annular chill roll 1 whereon it forms a molten filament 4 which is solidified through intimate contact with the relatively cooler chill roll. The resulting solid filament 4 is carried by the rotation of the chill roll into the vicinity of air knife 5. A continuous blast of air directed by air knife 5 against the inner surface of the chill roll strips the solid filament 4 from the inner surface of the chill roll and guides the stripped filament 4 away from the inner surface of the chill roll and towards a suitable collection device.

Figure 2:
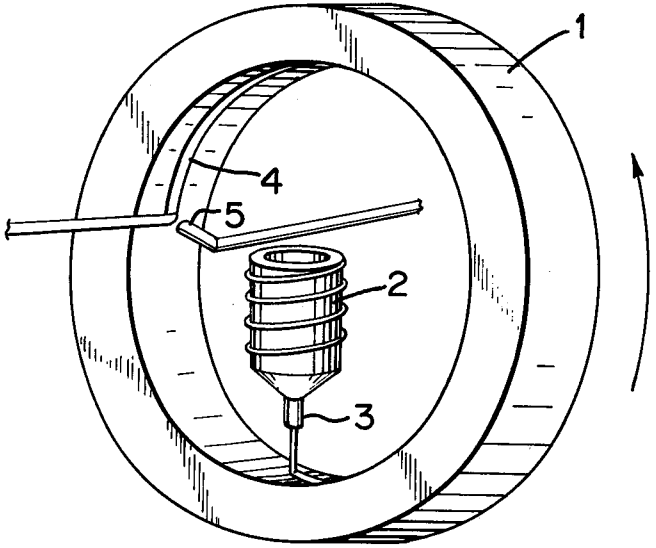
Figure 4:
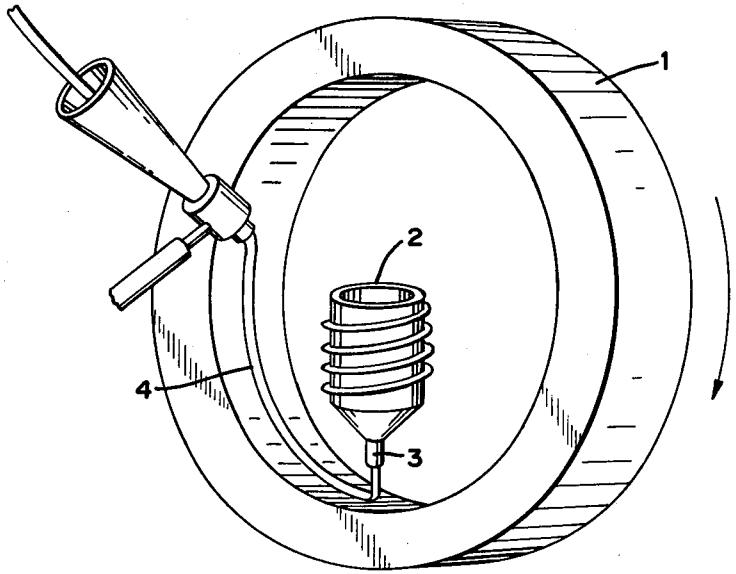

Operation of the embodiment of the present invention illustrated by FIG. 2 is identical to that illustrated by FIG. 1, except that it employs blade 6 in sliding contact with the inner surface of chill roll 1 for stripping the solidified metal filament from the inner surface of the chill roll, and employs guide 7 for guiding the stripped metal filament away from the chill roll and toward a suitable collection device.

A particular advantage of employing an annular chill roll having an inner surface substantially parallel to its axis of rotation, as compared to use of chill rolls wherein the inner surface if inclined at an angle to the axis of rotation, is that it permits making of straight filament of uniform cross section. Chill rolls having an inclined cross section have a tendency to make filament which is thicker on one side than on the other, and which further is cambered, hence has a built-in twist. A particular advantage of forming filaments by depositing a stream of molten metal against the inner surface of a rotating chill roll, as compared to deposition of such metal against the outer surface of such chill roll, is that the former provides more intimate and prolonged contact of the metal filament with the chill roll.

The molten material which is to be formed into a filament is heated, preferably in an inert atmosphere or under subatmospheric pressure to temperature approximately 50° to 100° C. above its melting point or higher. Ejection of the molten metal through a nozzle for deposition onto the chill roll may be effected by the pressure of the static head of the molten metal in the crucible, or by pressurizing crucible 2 to pressure in the order of, say, 1 to 20 p.s.i.g. or until a stream of molten metal is ejected through nozzle 3. Nozzle 3 may be provided with a tapered orifice, if desired, since tapering of the orifice along its length tends to enhance stability of the molten metal jet ejected therethrough.

The velocity at which the stream of molten metal is ejected and the rotational velocity of the chill roll are interrelated. The surface speed of the inner surface of the annular chill roll is desirably in the range of from about 1 to 20, preferably from about 1 to 5, more preferably yet from about 1 to 2.5 times the speed of the jet of molten metal. One of the considerations involving the velocity of the jet is the jet stability, that is the velocity must be sufficient to insure a continuous uniform jet stream. It must not be so great as to cause breakup of the stream at the point of impact with the cylinder. The jet stability varies with alloy composition. However, in general it has been found that ejection velocity within the range of about 180 to 260 centimeters per second will result in satisfactory stable jet. It is possible to adjust the rotational speed of the chill roll, within the above-stated limits, to obtain filament having desired dimensions.

The inner surface of chill roll 1 providing the actual quench surface can be any metal having relatively high thermal conductivity. This requirement is particularly applicable if it is desired to make amorphous or metastable filaments. Preferred materials of construction include beryllium copper, oxygen-free copper, and stainless steel. Since, unlike in previously known methods for making filaments wherein the molten metal is deposited on the exterior surface of a rotating chill roll, intimacy of the contact between the filament and the chill roll surface in our method does not depend upon surface adhesion but instead is provided by centrifugal force, the inner surface of the chill roll employed in the process of our invention can be highly polished and, if desired, by provided with a highly uniform surface such as by chrome plating to obtain metal filament having unusually smooth surface characteristics. Such smooth casting surfaces could not be employed on chill rolls whereon filament formation is effected on the exterior surface for lack of sufficient adhesion between the molten metal and the surface, resulting in splattering and failure to obtain desired filament. To provide protection against erosion, corrosion or thermal fatigue, the inner surface of the chill roll may be coated with a suitable resistant or high melting coating, for example a ceramic coating or a coating of corrosion resistant high melting metal, which may be applied by known procedures.

The filament may be stripped from the chill roll as soon as it is sufficiently solidified, but in any event at a location represented by an angle of rotation of the chill roll from the point of impingement of the jet of molten metal of less than 360°, generally less than about 320°, desirably less than about 270°.

Means for stripping the metal filament from the inner surface of the rotating chill roll include jets of fluids, such as air, inert gases or substantially inert liquids, including low melting metals above their melting point, directed against the inner surface of the chill roll, preferably at an angle so as to lift the metal filament from the surface whereon it is formed. Such means further include mechanical lifting devices, for example scraper blades constructed of suitable material such as ceramics, metals, plastics or graphite which are held in intimate sliding contact with the inner surface of the chill roll; also brushes, rotating or stationary, magnetic devices, if the filament has magnetic properties or aspirators which lift the filaments from the surface by means of suction.

Means for guiding the stripped metal film away from the chill roll and, optionally, towards a collection device include suitably shaped guides, rollers, or blasts of fluids such as air, gases or liquids.

Detailed design of apparatus of the present invention is within the capability of any competent worker skilled in the art.

The process of the present invention may be carried out in air, under partial or high vacuum, or in any desired atmosphere such as inert atmosphere as may be provided by an inert gas such as nitrogen, argon, helium, and the like. This can be simply accomplished by enclosing the apparatus in a suitable housing and evacuating it or replacing the air in the housing with a desired inert gas. When the process of the present invention is conducted under vacuum, formation of bubbles in the molten metal with concomitant pinhole formation in the filament is reduced. For that reason it is preferred to conduct the process under vacuum, say under absolute pressure of less than about 10 cm. Hg., preferably less than about 5 cm. Hg., more preferably at pressure of less than about 1000 micron.

Figure 5:
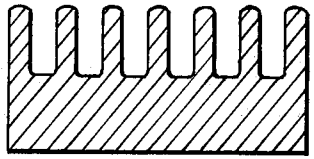
FIG. 5 is a fractional cross-section of an annular chill roll provided with a finned external surface for cooling purposes.
Figure 3:
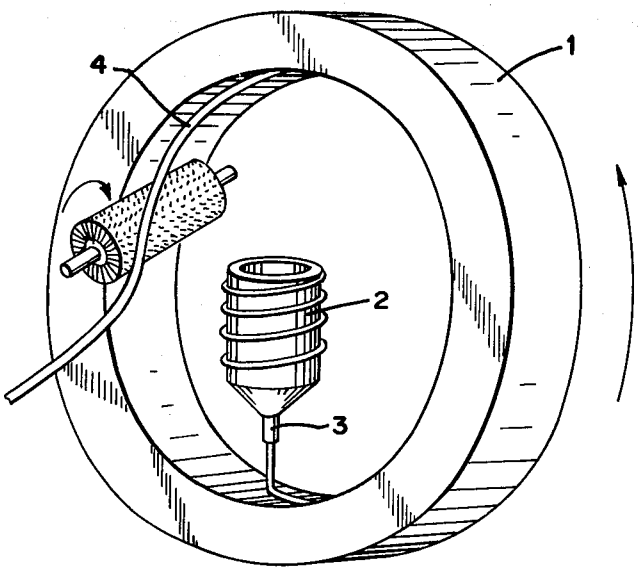

In short run operation it will not ordinarily be necessary to provide cooling for the chill roll if it is of relatively large mass so that it can act as a heat sink and absorb considerable amount of heat. However, for longer runs, especially under vacuum, cooling of the chill roll is desirably provided. This may be conveniently accomplished by circulating water or other cooling media therethrough, expecially if the process is conducted under vacuum, by blowing cool air or other gases over the chill roll, or as by evaporative cooling as by externally contacting the chill roll with water or any other liquid medium which through evaporation provides cooling. Alternatively, a stream of a liquified gas such as nitrogen or carbon dioxide may be directed against the chill roll for cooling purposes. To enhance cooling, it may be desirable to provide cooling fins around the outer perimeter of the chill roll as illustrated in FIG. 5. If the metal filament is stripped from the chill roll by means of a jet of a fluid, that fluid may provide concurrent cooling of the chill roll. Cooling of the chill roll, if operated under vacuum, may desirably be provided by means of a jet of low melting metal which is also used for stripping the filament from the chill roll.

If the process of the present invention is conducted other than in a vacuum, then the width of the inner surface of the chill roll, while not critical, is desirable relatively narrow with respect to the width of the filament to be produced, to permit relatively unimpeded lateral escape of the atmospheric gas at or near the point of inpingement of the molten metal jet onto the chill roll surface, thereby minimizing buffeting of the jet near the chill roll surface. Under such conditions, the width of the inner surface of the chill roll is desirably not more than about 2 to 3 times, preferably not more than about 1½ times the width of the filament being formed. A relatively narrow inner surface of the chill roll also facilitates withdrawal of the filament from the chill roll.

The shape of the jet of molten metal being directed against the inner surface of the chill roll is not particularly critical, provided it is sufficiently stable to form a continuous filament. The jet may be of substantially circular cross section or may be elongated to provide a wider filament. Alternatively, several jets may be directed against the chill roll in relatively close proximity so that the metal, which upon contacting the chill roll will spread, will form a relatively wide filament.

The following examples illustrate the present invention and set forth the best mode presently contemplated for its practice.

EXAMPLE I

Apparatus employed is similar to that depicted in FIG. 1. The chill roll employed has inner and outer diameters of 15 and 19 inches, respectively, and it is 1.5 inches wide. It is rotated at a speed of 470 rpm. An air knife frovides a jet of air at an angle of about 90° against the surface of the chill roll at a distance of about 270° from the point of impingement of the metal jet onto the chill roll. A crucible equipped with a nozzle having 0.18 inch diameter is charged with a molten alloy composed of $Fe_{25}Ni_{25}Cr_{10}B_{20}Co_{20}$. The alloy has a melting point of about 900° C. The alloy in the crucible is pressurized to pressure of 5 p.s.i.g. by means of an argon blanket and is ejected through the nozzle at temperature of about 940° C. at an angle of 90° with the inner surface of the chill roll. The ejection velocity of the metal and linear rotational velocity of the chill roll surface are approximately 224 and 875 cemtimeters per second, respectively. The stream is quenched and transported to the air knife, and is there stripped from the inner surface of the chill roll and blown out of the chill roll towards a collection device. Upon examination using X-ray diffraction, the filament is found to be amorphous in structure. The filament is about 0.0025 inch thick and has a width of 0.026 inch.

EXAMPLE II

Apparatus employed is similar to that depicted in FIG. 1 except that a motor-driven rotating brush is substituted for the air knife and that the apparatus is housed in a vacuum chamber. The chill roll employed has inner and outer diameters of 15 and 19 inches respectively and it is 1.5 inches wide. It is rotated at a speed of 1300 rpm. The rotating brush is set at an angle of 90° measured against the side of the chill roll to effect sideways ejection of the metal filament away from the chill roll. A crucible equipped with a nozzle having 0.028 inch diameter is charged with a molten alloy composed of $Fe_5Ni_{45}Cr_{10}B_{16}Co_{20}Mo_4$. The alloy has a melting point of about 1180° C. The alloy in the crucible is pressurized to pressure of about 7 p.s.i.g. by means of argon blanket and is ejected through the nozzle at temperature of about 1280° C. at an angle of 90° with the inner surface of the chill roll. The ejection velocity of the metal and linear rotational velocity of the chill roll surface are approximately 206 and 2419 centimeters per second, respectively. The filament removed from the inner surface of the chill roll by the rotating brush is of uniform quality and free of pinholes. Upon examination using X-ray diffraction, the filament is found to be amorphous in structure. The filament is about 0.0015 inch thick and has a width of about 0.035 inch.

Since various changes and modifications may be made in the invention without departing from the spirit and essential characteristics thereof, it is intended that all matter contained in the above description shall be interpreted illustrative only, the invention being limited only by the scope of the appended claims.

We claim:

1. Apparatus for making continuous metal filament comprising an annular chill roll mounted for rotation around its axis, said chill roll providing an inner casting surface which is in its entirety parallel to the axis of rotation of the chill roll; means for producing a jet of molten metal and directing it into the inner surface of the annular chill roll as it is being rotated; and means for stripping the metal filament from the inner surface of the rotating chill roll beyond the point of solidification of the molten metal deposited thereon, and for guiding the stripped metal filament away from the chill roll.

2. The apparatus of claim 1 wherein the means for stripping the filament from the inner surface of the chill roll comprise means for directing a fluid jet against the inner surface of the chill roll.

3. The apparatus of claim 1 wherein the means for stripping the filament from the inner surface of the chill roll comprise a scraper blade.

4. The apparatus of claim 1 wherein the means for stripping the filament from the inner surface of the chill roll comprise a rotatable brush.

5. The apparatus of claim 1 further including means for cooling the chill roll.

6. The apparatus of claim 1 enclosed in a vacuum chamber.

7. The apparatus of claim 6 wherein the means for stripping the filament from the inner surface of the chill roll comprises a rotatable brush.

8. A process for making metal filament which comprises directing a jet of molten metal onto the inner surface of a rotating annular chill roll, which inner surface in its entirety is parallel to the axis of rotation of the chill roll, stripping the metal filament formed by solidification of the molten metal in contact with the inner surface of the rotating chill roll at a point beyond which solidification occurred, and guiding the stripped metal filament away from the inner surface of the chill roll.

9. The process of claim 8 wherein the metal filament is stripped from the chill roll by directing a jet of fluid against the inner surface of the chill roll so as to lift the filament from that surface.

10. The method of claim 9 wherein the jet of fluid is a jet of air.

11. The method of claim 8 wherein the metal filament is stripped from the chill roll by means of suction supplied by an aspirator.

12. The method of claim 8 wherein the metal filament is stripped from the chill roll by means of a rotating brush.

13. The method of claim 8 wherein the metal filament is stripped from the chill roll by means of a scraper blade.

14. The method of claim 8 conducted under reduced pressure.

15. The method of claim 14 wherein the filament is stripped from the chill roll by mens of a rotating brush.

* * * * *